US010186750B2

(12) United States Patent
Shtrom et al.

(10) Patent No.: US 10,186,750 B2
(45) Date of Patent: Jan. 22, 2019

(54) RADIO FREQUENCY ANTENNA ARRAY WITH SPACING ELEMENT

(75) Inventors: Victor Shtrom, Los Altos, CA (US); Bernard Baron, Mountain View, CA (US); Chia Ching Ling, San Jose, CA (US)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 13/396,484

(22) Filed: Feb. 14, 2012

(65) Prior Publication Data

US 2013/0207877 A1 Aug. 15, 2013

(51) Int. Cl.

| | |
|---|---|
| ***H01Q 1/22*** | (2006.01) |
| ***H01Q 1/24*** | (2006.01) |
| ***H01Q 9/22*** | (2006.01) |
| ***H01Q 9/28*** | (2006.01) |
| ***H01Q 21/06*** | (2006.01) |
| ***H01Q 21/10*** | (2006.01) |
| ***H01Q 21/24*** | (2006.01) |

(52) U.S. Cl.

CPC ..... *H01Q 1/2266* (2013.01); *H01Q 1/243* (2013.01); *H01Q 9/22* (2013.01); *H01Q 9/285* (2013.01); *H01Q 21/062* (2013.01); *H01Q 21/10* (2013.01); *H01Q 21/24* (2013.01)

(58) Field of Classification Search

CPC ..... H01Q 9/285; H01Q 21/062; H01Q 21/10; H01Q 5/48; H01Q 13/04; H01Q 9/265; H01Q 9/16; H01Q 9/44; H01Q 9/065; H01Q 19/13; H01Q 19/108; H01Q 19/04

USPC ..... 343/893

See application file for complete search history.

(56) References Cited

U.S. PATENT DOCUMENTS

| | | | |
|---|---|---|---|
| 725,605 | A | 4/1903 | Tesla |
| 1,869,659 | A | 8/1932 | Broertjes |
| 2,292,387 | A | 8/1942 | Markey et al. |

(Continued)

FOREIGN PATENT DOCUMENTS

| | | |
|---|---|---|
| AU | 2003/227399 | 10/2003 |
| CA | 02494982 | 10/2003 |

(Continued)

OTHER PUBLICATIONS

Abramov 2003—P.R. 3-3© Chart for U.S. Pat. No. 7,525,486 and U.S. Pat. No. 7,193,562.

(Continued)

*Primary Examiner* — Hoang Nguyen
*Assistant Examiner* — Awat Salih
(74) *Attorney, Agent, or Firm* — Stewart M. Wiener

(57) ABSTRACT

A spacing member is positioned between a pair of antenna members. The two antenna members may be horizontally polarized or vertically polarized and positioned next to each other to provide an increased gain. The spacing element may be placed between the antenna members and have a thickness corresponding to the characteristic impedance of the antenna transmission line. The characteristic impedance may be determined based on the width of the transmission line. The spacing member may be radio-frequency (RF) transparent and may adhere to either or both of the antenna elements. The spacing member may be implemented as a plastic double sided tape or a uniform piece of plastic having one or more adhesive layers.

8 Claims, 6 Drawing Sheets

(56) References Cited

U.S. PATENT DOCUMENTS 3,488,445 A 1/1970 Chang
3,568,105 A 3/1971 Felsenheld
3,721,990 A 3/1973 Gibson et al.
3,887,925 A 6/1975 Ranghelli
3,967,067 A 6/1976 Potter
3,969,730 A 7/1976 Fuchser
3,982,214 A 9/1976 Burns
3,991,273 A 11/1976 Mathes
4,001,734 A 1/1977 Burns
4,027,307 A 5/1977 Litchford
4,176,356 A 11/1979 Foster et al.
4,193,077 A 3/1980 Greenberg et al.
4,203,118 A 5/1980 Alford
4,253,193 A 2/1981 Kennard
4,305,052 A 12/1981 Baril et al.
4,513,412 A 4/1985 Cox
4,554,554 A 11/1985 Olesen et al.
4,733,203 A 3/1988 Ayasli
4,764,773 A 8/1988 Larsen et al.
4,800,393 A 1/1989 Edward et al.
4,814,777 A 3/1989 Monser
4,821,040 A 4/1989 Johnson et al.
4,920,285 A 4/1990 Clark et al.
4,937,585 A 6/1990 Shoemaker
5,063,574 A 11/1991 Moose
5,097,484 A 3/1992 Akaiwa
5,173,711 A 12/1992 Takeuchi et al.
5,203,010 A 4/1993 Felix
5,208,564 A 5/1993 Burns et al.
5,220,340 A 6/1993 Shafai
5,241,693 A 8/1993 Kim
5,282,222 A 1/1994 Fattouche et al.
5,291,289 A 3/1994 Hulyalkar et al.
5,311,550 A 5/1994 Fouche et al.
5,337,066 A 8/1994 Hirata et al.
5,373,548 A 12/1994 McCarthy
5,434,575 A 7/1995 Jelinek
5,448,253 A * 9/1995 Ponce de Leon ..... H01Q 1/243 343/702
5,453,752 A 9/1995 Wang et al.
5,479,176 A 12/1995 Zavrel
5,507,035 A 4/1996 Bantz
5,532,708 A 7/1996 Krenz et al.
5,559,800 A 9/1996 Mousseau et al.
5,629,713 A * 5/1997 Mailandt ..... H01Q 1/246 343/792.5
5,726,666 A 3/1998 Hoover et al.
5,754,145 A 5/1998 Evans
5,767,755 A 6/1998 Kim et al.
5,767,807 A 6/1998 Prtichett
5,767,809 A 6/1998 Chuang et al.
5,786,793 A 7/1998 Maeda et al.
5,802,312 A 9/1998 Lazaridis et al.
5,828,346 A 10/1998 Park
5,936,595 A 8/1999 Wang
5,964,830 A 10/1999 Durrett
5,966,102 A 10/1999 Runyon
5,990,838 A * 11/1999 Burns ..... H01Q 1/38 343/702
6,005,519 A 12/1999 Burns
6,005,525 A 12/1999 Kivela
6,011,450 A 1/2000 Miya
6,023,250 A 2/2000 Cronyn
6,031,503 A 2/2000 Preiss, II et al.
6,034,638 A 3/2000 Thiel et al.
6,046,703 A 4/2000 Wang
6,052,093 A 4/2000 Yao et al.
6,061,025 A 5/2000 Jackson
6,067,053 A * 5/2000 Runyon et al. ..... 343/797
6,091,364 A 7/2000 Murakami et al.
6,094,177 A 7/2000 Yamamoto
6,097,347 A 8/2000 Duan et al.
6,104,356 A 8/2000 Hikuma et al.
6,169,523 B1 1/2001 Ploussios
6,249,216 B1 6/2001 Flick
6,266,528 B1 7/2001 Farzaneh
6,281,762 B1 8/2001 Nakao
6,288,682 B1 9/2001 Thiel et al.
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,326,924 B1 12/2001 Muramoto et al.
6,337,628 B2 1/2002 Campana, Jr.
6,337,668 B1 1/2002 Ito et al.
6,339,404 B1 1/2002 Johnson
6,345,043 B1 2/2002 Hsu
6,351,240 B1 2/2002 Karimullah et al.
6,356,242 B1 3/2002 Ploussios
6,356,243 B1 3/2002 Schneider et al.
6,356,905 B1 3/2002 Gershman et al.
6,366,254 B1 4/2002 Sivenpiper
6,377,227 B1 * 4/2002 Zhu et al. ..... 343/795
6,392,610 B1 5/2002 Braun et al.
6,396,456 B1 * 5/2002 Chiang et al. ..... 343/795
6,400,329 B1 6/2002 Barnes
6,400,332 B1 * 6/2002 Tsai ..... H01Q 9/285 343/700 MS
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skidmore et al.
6,445,688 B1 9/2002 Garces et al.
6,456,242 B1 9/2002 Crawford
6,476,773 B2 11/2002 Palmer
6,492,957 B2 12/2002 Carillo et al.
6,493,679 B1 12/2002 Rappaport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,521,422 B1 2/2003 Hsu
6,531,985 B1 3/2003 Jones et al.
6,545,643 B1 4/2003 Sward
6,583,765 B1 6/2003 Schamberget et al.
6,586,786 B2 7/2003 Kitazawa et al.
6,593,891 B2 7/2003 Zhang
6,606,059 B1 8/2003 Barabash
6,611,230 B2 8/2003 Phelan
6,621,029 B2 9/2003 Galmiche
6,625,454 B1 9/2003 Rappaport et al.
6,633,206 B1 10/2003 Kato
6,642,889 B1 11/2003 McGrath
6,642,890 B1 11/2003 Chen
6,674,459 B2 1/2004 Ben-Shachar et al.
6,700,546 B2 3/2004 Benhammou et al.
6,701,522 B1 3/2004 Rubin et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,757,267 B1 6/2004 Evans
6,762,723 B2 7/2004 Nallo et al.
6,774,852 B2 8/2004 Chiang et al.
6,774,864 B2 8/2004 Evans
6,779,004 B1 8/2004 Zintel et al.
6,819,287 B2 11/2004 Sullivan et al.
6,822,617 B1 11/2004 Mather et al.
6,839,038 B2 1/2005 Weinstein
6,859,176 B2 2/2005 Choi
6,859,182 B2 2/2005 Horii
6,864,852 B2 3/2005 Chiang et al.
6,876,280 B2 4/2005 Nakano
6,876,836 B2 4/2005 Lin
6,879,293 B2 4/2005 Sato
6,888,504 B2 5/2005 Chiang et al.
6,888,893 B2 5/2005 Li et al.
6,892,230 B1 5/2005 Gu et al.
6,894,653 B2 5/2005 Chiang et al.
6,903,686 B2 6/2005 Vance et al.

(56) References Cited

U.S. PATENT DOCUMENTS 6,906,678 B2 6/2005 Chen
6,910,068 B2 6/2005 Zintel et al.
6,914,566 B2 7/2005 Beard
6,914,581 B1 7/2005 Popek
6,924,768 B2 8/2005 Wu et al.
6,931,429 B2 8/2005 Gouge et al.
6,933,907 B2 8/2005 Shirosaka
6,941,143 B2 9/2005 Mathur
6,943,749 B2 9/2005 Paun
6,950,019 B2 9/2005 Bellone et al.
6,950,069 B2 9/2005 Gaucher et al.
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,024,225 B2 4/2006 Ito
7,034,769 B2 4/2006 Surducan et al.
7,034,770 B2 4/2006 Yang et al.
7,043,277 B1 5/2006 Pfister
7,046,201 B2 5/2006 Okada
7,050,809 B2 5/2006 Lim
7,053,844 B2 5/2006 Gaucher et al.
7,064,717 B2 6/2006 Kaluzni
7,085,814 B1 8/2006 Ghandi et al.
7,088,299 B2 8/2006 Siegler et al.
7,088,306 B2 8/2006 Chiang et al.
7,089,307 B2 8/2006 Zintel et al.
7,098,863 B2 8/2006 Bancroft
D530,325 S 10/2006 Kerila
7,120,405 B2 10/2006 Rofougaran
7,130,895 B2 10/2006 Zintel et al.
7,148,846 B2 12/2006 Qi et al.
7,162,273 B1 1/2007 Ambramov et al.
7,164,380 B2 1/2007 Saito
7,171,475 B2 1/2007 Weisman et al.
7,193,562 B2 3/2007 Shtrom
7,206,610 B2 4/2007 Iacono et al.
7,215,296 B2 5/2007 Ambramov et al.
7,277,063 B2 10/2007 Shirosaka et al.
7,292,198 B2 11/2007 Shtrom
7,292,870 B2 11/2007 Heredia et al.
7,295,825 B2 11/2007 Shtrom et al.
7,298,228 B2 11/2007 Sievenpiper
7,312,762 B2 12/2007 Puente Ballarda et al.
7,319,432 B2 1/2008 Andersson
7,333,460 B2 2/2008 Vaisanen et al.
7,358,912 B1 * 4/2008 Kish ..... H01Q 3/242 343/725
7,362,280 B2 * 4/2008 Shtrom ..... H01Q 3/24 343/795
7,385,563 B2 6/2008 Bishop
7,498,999 B2 3/2009 Shtrom et al.
7,511,680 B2 3/2009 Shtrom et al.
7,522,569 B2 4/2009 Rada
7,525,486 B2 4/2009 Shtrom
7,609,648 B2 10/2009 Hoffmann et al.
7,697,550 B2 4/2010 Rada
7,733,275 B2 6/2010 Hirota
7,782,895 B2 8/2010 Pasanen et al.
7,835,697 B2 11/2010 Wright
7,847,741 B2 12/2010 Hirota
7,864,119 B2 1/2011 Shtrom et al.
7,893,882 B2 2/2011 Shtrom
7,916,463 B2 3/2011 Aya et al.
8,068,068 B2 11/2011 Kish et al.
8,085,206 B2 12/2011 Shtrom
8,217,843 B2 7/2012 Shtrom
8,355,912 B1 1/2013 Keesey et al.
8,358,248 B2 1/2013 Shtrom
8,686,905 B2 4/2014 Shtrom
8,704,720 B2 4/2014 Kish
8,723,741 B2 5/2014 Shtrom
8,756,668 B2 6/2014 Shtrom
8,836,606 B2 9/2014 Kish
9,019,165 B2 4/2015 Shtrom
9,093,758 B2 7/2015 Kish
2001/0046848 A1 11/2001 Kenkel
2002/0031130 A1 3/2002 Tsuchiya et al.
2002/0036586 A1 3/2002 Gothard et al.
2002/0047800 A1 4/2002 Proctor, Jr. et al.
2002/0080767 A1 6/2002 Lee
2002/0084942 A1 7/2002 Tsai et al.
2002/0101377 A1 8/2002 Crawford
2002/0105471 A1 8/2002 Kojima et al.
2002/0112058 A1 8/2002 Weisman et al.
2002/0119757 A1 8/2002 Hamabe
2002/0158798 A1 10/2002 Chiang et al.
2002/0163473 A1 11/2002 Koyama et al.
2002/0170064 A1 11/2002 Monroe et al.
2003/0026240 A1 2/2003 Eyuboglu et al.
2003/0030588 A1 * 2/2003 Kalis ..... H01Q 1/38 343/700 MS
2003/0034917 A1 * 2/2003 Nishizawa ..... H01Q 1/38 343/700 MS
2003/0038698 A1 2/2003 Hirayama
2003/0063591 A1 4/2003 Leung et al.
2003/0122714 A1 7/2003 Wannagot et al.
2003/0169330 A1 9/2003 Ben-Shachar et al.
2003/0174099 A1 9/2003 Bauer et al.
2003/0184490 A1 10/2003 Raiman et al.
2003/0184492 A1 10/2003 Chiang et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0214445 A1 * 11/2003 Hsiao ..... H01Q 1/38 343/700 MS
2003/0214446 A1 11/2003 Shehab
2003/0227414 A1 12/2003 Saliga et al.
2004/0001026 A1 * 1/2004 Killen ..... H01Q 7/00 343/795
2004/0001027 A1 * 1/2004 Killen ..... H01Q 1/38 343/795
2004/0014432 A1 1/2004 Boyle
2004/0017310 A1 1/2004 Vargas-Hurlston et al.
2004/0017315 A1 1/2004 Fang et al.
2004/0017860 A1 1/2004 Liu
2004/0027291 A1 2/2004 Zhang et al.
2004/0027304 A1 2/2004 Chiang et al.
2004/0030900 A1 2/2004 Clark
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0075609 A1 * 4/2004 Li ..... H01Q 9/38 343/700 MS
2004/0080455 A1 4/2004 Lee
2004/0090371 A1 5/2004 Rossman
2004/0095278 A1 5/2004 Kanemoto et al.
2004/0114535 A1 6/2004 Hoffmann et al.
2004/0125777 A1 7/2004 Doyle et al.
2004/0145528 A1 7/2004 Mukai et al.
2004/0153647 A1 8/2004 Rotholtz et al.
2004/0160376 A1 8/2004 Hornsby et al.
2004/0183727 A1 * 9/2004 Choi ..... H01Q 1/22 343/700 MS
2004/0190477 A1 9/2004 Olson et al.
2004/0203347 A1 10/2004 Nguyen
2004/0207563 A1 10/2004 Yang
2004/0227669 A1 11/2004 Okada
2004/0260800 A1 12/2004 Gu et al.
2005/0022210 A1 1/2005 Zintel et al.
2005/0035919 A1 * 2/2005 Yang ..... H01Q 1/38 343/795
2005/0041739 A1 2/2005 Li et al.
2005/0042988 A1 2/2005 Hoek et al.
2005/0048934 A1 3/2005 Rawnick et al.

(56) References Cited

U.S. PATENT DOCUMENTS

2005/0050352 A1 3/2005 Narayanaswami et al.
2005/0062649 A1 3/2005 Chiang et al.
2005/0074018 A1 4/2005 Zintel et al.
2005/0097503 A1 5/2005 Zintel et al.
2005/0122265 A1 6/2005 Gaucher et al.
2005/0128983 A1 6/2005 Kim et al.
2005/0128988 A1 6/2005 Simpson et al.
2005/0135480 A1 6/2005 Li et al.
2005/0138137 A1 6/2005 Encarnacion et al.
2005/0138193 A1 6/2005 Encarnacion et al.
2005/0146475 A1 7/2005 Bettner et al.
2005/0180381 A1 8/2005 Retzer et al.
2005/0184920 A1 8/2005 Mahler et al.
2005/0188193 A1 8/2005 Kuehnel et al.
2005/0237258 A1* 10/2005 Abramov ..... H01Q 3/24 343/834
2005/0240665 A1 10/2005 Gu et al.
2005/0267935 A1 12/2005 Gandhi et al.
2006/0031922 A1 2/2006 Sakai
2006/0038734 A1 2/2006 Shtrom et al.
2006/0050005 A1 3/2006 Shirosaka et al.
2006/0094371 A1 5/2006 Nguyen
2006/0098607 A1 5/2006 Zeng et al.
2006/0109191 A1* 5/2006 Shtrom ..... H01Q 1/38 343/795
2006/0111902 A1 5/2006 Julia et al.
2006/0123124 A1 6/2006 Weisman et al.
2006/0123125 A1 6/2006 Weisman et al.
2006/0123455 A1 6/2006 Pai et al.
2006/0168159 A1 7/2006 Weisman et al.
2006/0184660 A1 8/2006 Rao et al.
2006/0184661 A1 8/2006 Weisman et al.
2006/0184693 A1 8/2006 Rao et al.
2006/0224690 A1 10/2006 Falkenburg et al.
2006/0225107 A1 10/2006 Seetharaman et al.
2006/0227062 A1 10/2006 Francque et al.
2006/0227761 A1 10/2006 Scott, III et al.
2006/0239369 A1 10/2006 Lee
2006/0251256 A1 11/2006 Asokan et al.
2006/0262015 A1 11/2006 Thornell-Pers et al.
2006/0291434 A1 12/2006 Gu et al.
2007/0001922 A1* 1/2007 Song ..... H01Q 9/285 343/795
2007/0027622 A1 2/2007 Cleron et al.
2007/0037619 A1 2/2007 Matsunaga et al.
2007/0046558 A1* 3/2007 Tillery ..... H01Q 1/246 343/797
2007/0055752 A1 3/2007 Wiegand et al.
2007/0063913 A1* 3/2007 Wu ..... H01Q 21/0075 343/824
2007/0115180 A1 5/2007 Kish et al.
2007/0124490 A1 5/2007 Kalavade et al.
2007/0130294 A1 6/2007 Nishio
2007/0135167 A1 6/2007 Liu
2008/0060064 A1 3/2008 Wynn et al.
2008/0075280 A1 3/2008 Ye et al.
2008/0096492 A1 4/2008 Yoon
2008/0062058 A1 5/2008 Bishop
2008/0109657 A1 5/2008 Bajaj et al.
2008/0136715 A1 6/2008 Shtrom
2008/0139136 A1* 6/2008 Shtrom ..... H01Q 3/242 455/101
2008/0204331 A1* 8/2008 Shtrom ..... H01Q 1/241 343/702
2008/0212535 A1 9/2008 Karaoguz et al.
2008/0272977 A1 11/2008 Gaucher et al.
2009/0005005 A1 1/2009 Forstall et al.
2009/0103731 A1 4/2009 Sarikaya
2009/0187970 A1 7/2009 Mower et al.
2009/0217048 A1 8/2009 Smith
2009/0219903 A1 9/2009 Alamouti et al.
2009/0251380 A1* 10/2009 Kuramoto ..... H01Q 7/02 343/843
2009/0295648 A1 12/2009 Dorsey et al.
2009/0315794 A1 12/2009 Alamouti et al.
2010/0053010 A1* 3/2010 Shtrom ..... H01Q 9/285 343/749
2010/0053023 A1 3/2010 Shtrom
2010/0103065 A1* 4/2010 Shtrom ..... H01Q 3/24 343/795
2010/0103066 A1* 4/2010 Shtrom ..... H01Q 3/24 343/834
2010/0299518 A1 11/2010 Viswanathan et al.
2010/0332828 A1 12/2010 Goto
2011/0007705 A1 1/2011 Buddhikot et al.
2011/0040870 A1 2/2011 Wynn et al.
2011/0043424 A1* 2/2011 Lee ..... H01Q 1/246 343/816
2011/0047603 A1 2/2011 Gordon et al.
2011/0095960 A1 4/2011 Shtrom
2011/0126016 A1 5/2011 Sun
2011/0208866 A1 8/2011 Marmolejo-Meillon et al.
2012/0030466 A1 2/2012 Yamaguchi
2012/0054338 A1 3/2012 Ando
2012/0089845 A1 4/2012 Raleigh
2012/0098730 A1 4/2012 Kish
2012/0134291 A1 5/2012 Raleigh
2012/0257536 A1 10/2012 Kholaif et al.
2012/0284785 A1 11/2012 Salkintzis et al.
2012/0299772 A1 11/2012 Shtrom
2012/0322035 A1 12/2012 Julia et al.
2013/0007853 A1 1/2013 Gupta et al.
2013/0038496 A1 2/2013 Shtrom
2013/0047218 A1 2/2013 Smith
2013/0182693 A1 7/2013 Sperling et al.
2013/0207865 A1 8/2013 Shtrom
2013/0207866 A1 8/2013 Shtrom
2013/0212656 A1 8/2013 Shtrom
2013/0215832 A1* 8/2013 Gao ..... H01Q 21/26 370/328
2013/0241789 A1 9/2013 Shtrom
2013/0269008 A1 10/2013 Shtrom
2014/0210681 A1 7/2014 Shtrom
2014/0282951 A1 9/2014 Ranade
2014/0334322 A1 11/2014 Shtrom
2015/0070243 A1 3/2015 Kish

FOREIGN PATENT DOCUMENTS

DE 10 2006 026350 12/2006
EP 352 787 1/1990
EP 0 534 612 3/1993
EP 0 756 381 1/1997
EP 0 883 206 12/1998
EP 1 152 452 11/2001
EP 1 152 542 11/2001
EP 1 152 543 11/2001
EP 1 376 920 6/2002
EP 1 220 461 7/2002
EP 1 315 311 5/2003
EP 1 450 521 8/2004
EP 1 608 108 12/2005
EP 1 909 358 4/2008
EP 1 287 588 1/2009
GB 2 426 870 6/2006
GB 2 423 191 8/2006
JP 03038933 2/1991
JP 2008/088633 4/1996
JP 2001-057560 2/2001
JP 2002-505835 2/2002
JP 2005-354249 12/2005
JP 2006/060408 3/2006
TW 201351188 12/2013
WO WO 90/04893 5/1990
WO WO 99/55012 10/1999
WO WO 01/013461 2/2001
WO WO 2001/69724 9/2001
WO WO 02/07258 A2 1/2002
WO WO 02/07258 A3 1/2002
WO WO 02/25967 3/2002
WO WO 03/079484 9/2003
WO WO 2003/081718 10/2003

(56) References Cited

FOREIGN PATENT DOCUMENTS

| | | |
|---|---|---|
| WO | WO 2004/051798 | 6/2004 |
| WO | WO 2006/023247 | 3/2006 |
| WO | WO 2006/057679 | 6/2006 |
| WO | WO 2007/076105 | 7/2007 |
| WO | WO 2007/127087 | 11/2007 |
| WO | WO 2013/119750 | 8/2013 |
| WO | WO 2013/152027 | 10/2013 |

OTHER PUBLICATIONS

Airgain 2004—P.R. 3-3© Chart for U.S. Pat. No. 7,525,486 and U.S. Pat. No. 7,193,562.
Cetiner 2003—P.R. 3-3© Chart for U.S. Pat. No. 7,525,486 and U.S. Pat. No. 7,193,562.
Chuang 2003—P.R. 3-3© Chart for U.S. Pat. No. 7,525,486 and U.S. Pat. No. 7,193,562.
Kalis 2000—P.R. 3-3© Chart for U.S. Pat. No. 7,525,486 and U.S. Pat. No. 7,193,562.
Kalis 2002—P.R. 3-3© Chart for U.S. Pat. No. 7,525,486.
Qian 2000—P.R. 3-3© Chart for U.S. Pat. No. 7,525,486 and U.S. Pat. No. 7,193,562.
Shehab 2003—P.R. 3-3© Chart for U.S. Pat. No. 7,525,486 and U.S. Pat. No. 7,193,562.
Simons 1994—P.R. 3-3© Chart for U.S. Pat. No. 7,525,486 and U.S. Pat. No. 7,193,562.
Vaughan 1995—P.R. 3-3© Chart for U.S. Pat. No. 7,525,486 and U.S. Pat. No. 7,193,562.
Bargh et al., "Fast Authentication Methods for Handovers between IEEE 802.11 Wireless LANs", Proceedings of the ACM International Workshop on Wireless Mobile Applications and Services on WLAN Hotspots. Oct. 1, 2004.
Kassab et al., "Fast Pre-Authentication Based on Proactive Key Distribution for 802.11 Infrastructure Networks", WMuNeP'05, Oct. 13, 2005, Montreal, Quebec, Canada, Copyright 2005 ACM.
European Second Examination Report for EP Application No. 09014989.9 dated Dec. 13, 2013.
Taiwan Application No. 094141018, Office Action dated May 8, 2013.
U.S. Appl. No. 13/653,405, Office Action dated Dec. 19, 2013.
Encrypted Preshared key; cisco corp. 14 pages, 2010.
Request for Inter Partes Rexamination for U.S. Pat. No. 7,358,912, filed by Rayspan Corporation and Netgear, Inc. dated Sep. 4, 2008.
Third Party Comments after Patent Owner's Response in Accordance with 37 CFR 1.947 for U.S. Pat. No. 7,358,912 (Control No. 95/001079) dated Jul. 17, 2009.
U.S. Appl. No. 95/001,078, Sep. 4, 2008, Shtrom et al. (Re-Exam).
U.S. Appl. No. 95/001,079, Sep. 4, 2008, Shtrom et al. (Re-Exam).
PCT Application No. PCT/US2005/027169, International Search Report and Written Opinion dated Aug. 10, 2006.
PCT Application No. PCT/US2013/34997, International Search Report dated Jun. 17, 2013.
Chinese Application No. 20058001532.6, Office Action dated Jun. 23, 2011.
Chinese Application No. 200910258884.X, Office Action dated Apr. 15, 2013.
Taiwan Application No. 094127953, Office Action dated Aug. 16, 2011.
U.S. Appl. No. 12/404,127, Final Office Action dated Feb. 7, 2012.
U.S. Appl. No. 12/404,127, Office Action dated Sep. 19, 2011.
U.S. Appl. No. 11/877,465, Final Office Action dated May 16, 2013.
U.S. Appl. No. 11/877,465, Office Action dated Oct. 3, 2012.
U.S. Appl. No. 11/877,465, Final Office Action dated Jun. 20, 2012.
U.S. Appl. No. 11/877,465, Office Action dated Sep. 19, 2011.
U.S. Appl. No. 11/877,465, Final Office Action dated Dec. 9, 2010.
U.S. Appl. No. 11/877,465, Office Action dated Apr. 12, 2010.
U.S. Appl. No. 12/980,253, Final Office Action dated Jun. 6, 2013.
U.S. Appl. No. 12/980,253, Office Action dated Aug. 17, 2012.
U.S. Appl. No. 12/980,253, Office Action dated Sep. 13, 2011.
U.S. Appl. No. 12/980,253, Office Action dated Mar. 1, 2011.
U.S. Appl. No. 12/425,374, Office Action dated Jul. 6, 2010.
U.S. Appl. No. 13/653,405, Office Action dated Dec. 19, 2012.
U.S. Appl. No. 13/731,273, Office Action dated May 23, 2013.
U.S. Appl. No. 13/396,482, Office Action dated Oct. 18, 2013.
U.S. Appl. No. 13/370,201, Office Action dated May 13, 2013.
U.S. Appl. No. 13/439,844, Final Office Action dated Oct. 28, 2013.
U.S. Appl. No. 13/439,844, Office Action dated Jun. 5, 2013.
U.S. Appl. No. 11/877,465, Office Action dated Jul. 29, 2014.
U.S. Appl. No. 13/396,482, Office Action dated Sep. 16, 2014.
Google, "Hotspots pre-shared keys". Date of download: Nov. 24, 2014.
IEEE Xplore Digital Library "Hotspots shared keys". Date of download: Nov. 24, 2014.
PCT Application No. PCT/US2013/34997, Written Opinion dated Jun. 17, 2013 (Date of Online Publication: Oct. 4, 2014).
U.S. Appl. No. 12/980,253, Final Office Action dated Jan. 23, 2015.
U.S. Appl. No. 13/396,482, Final Office Action dated Jan. 22, 2015.
U.S. Appl. No. 13/862,834, Office Action dated Apr. 27, 2015.
U.S. Appl. No. 12/980,253, Office Action dated Sep. 28, 2015.
U.S. Appl. No. 13/862,834, Final Office Action dated Sep. 22, 2015.
U.S. Appl. No. 13/396,482, Office Action dated Aug. 20, 2015.
Alard, M., et al., "Principles of Modulation and Channel Coding for Digital Broadcasting for Mobile Receivers," 8301 EBU Review Technical, Aug. 1987, No. 224, Brussels, Belgium.
Ando et al., "Study of Dual-Polarized Omni-Directional Antennas for 5.2 GHz-Band 2x2 MIMO-OFDM Systems," Antennas and Propogation Society International Symposium, 2004, IEEE, pp. 1740-1743 vol. 2.
Areg Alimian et al., "Analysis of Roaming Techniques," doc.:IEEE 802.11-04/0377r1, Submission, Mar. 2004.
"Authorization of Spread Spectrum Systems Under Parts 15 and 90 of the FCC Rules and Regulations," Rules and Regulations Federal Communications Commission, 47 CFR Part 2, and 90, Jun. 18, 1985.
"Authorization of spread spectrum and other wideband emissions not presently provided for in the FCC Rules and Regulations," Before the Federal Communications Commission, FCC 81-289, 87 F.C.C.2d 876, Jun. 30, 1981.
Bedell, Paul, "Wireless Crash Course," 2005, p. 84, The McGraw-Hill Companies, Inc., USA.
Behdad et al., Slot Antenna Miniaturization Using Distributed Inductive Loading, Antenna and Propagation Society International Symposium, 2003 IEEE, vol. 1, pp. 308-311 (Jun. 2003).
Berenguer, Inaki, et al., "Adaptive MIMO Antenna Selection," Nov. 2003.
Casas, Eduardo F., et al., "OFDM for Data Communication Over Mobile Radio FM Channels—Part I: Analysis and Experimental Results," IEEE Transactions on Communications, vol. 39, No. 5, May 1991, pp. 783-793.
Casas, Eduardo F., et al., "OFDM for Data Communication over Mobile Radio FM Channels; Part II: Performance Improvement," Department of Electrical Engineering, University of British Columbia.
Chang, Nicholas B. et al., "Optimal Channel Probing and Transmission Scheduling for Opportunistics Spectrum Access," Sep. 2007.
Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Chang, Robert W., "Synthesis of Band-Limited Orthogonal Signals for Multichannel Data Transmission," The Bell System Technical Journal, Dec. 1966, pp. 1775-1796.C.
Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).
Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.
Cisco Systems, "Cisco Aironet Access Point Software Configuration Guide: Configuring Filters and Quality of Service," Aug. 2003.

(56) References Cited

OTHER PUBLICATIONS

Dell Inc., "How Much Broadcast and Multicast Traffic Should I Allow in My Network," PowerConnect Application Note #5, Nov. 2003.
Dutta, Ashutosh et al., "MarconiNet Supporting Streaming Media Over Localized Wireless Multicast," Proc. of the 2d Int'l Workshop on Mobile Commerce, 2002.
Dunkels, Adam et al., "Making TCP/IP Viable for Wireless Sensor Networks," Proc. of the 1st Euro. Workshop on Wireless Sensor Networks, Berlin, Jan. 2004.
Dunkels, Adam et al., "Connecting Wireless Sensornets with TCP/IP Networks," Proc. of the 2d Int'l Conf. on Wired Networks, Frankfurt, Feb. 2004.
English Translation of PCT Pub. No. WO2004/051798 (as filed US National Stage U.S. Appl. No. 10/536,547).
Festag, Andreas, "What is MOMBASA?" Telecommunication Networks Group (TKN), Technical University of Berlin, Mar. 7, 2002.
Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Golmie, Nada, "Coexistence in Wireless Networks: Challenges and System-Level Solutions in the Unlicensed Bands," Cambridge University Press, 2006.
Hewlett Packard, "HP ProCurve Networking: Enterprise Wireless LAN Networking and Mobility Solutions," 2003.
Hirayama, Koji et al., "Next-Generation Mobile-Access IP Network," Hitachi Review vol. 49, No. 4, 2000.
Ian F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology.
Information Society Technologies Ultrawaves, "System Concept / Architecture Design and Communication Stack Requirement Document," Feb. 23, 2004.
Ken Tang, et al., "MAC Layer Broadcast Support in 802.11 Wireless Networks," Computer Science Department, University of California, Los Angeles, 2000 IEEE, pp. 544-548.
Ken Tang, et al., "MAC Reliable Broadcast in Ad Hoc Networks," Computer Science Department, University of California, Los Angeles, 2001 IEEE, pp. 1008-1013.
Mawa, Rakesh, "Power Control in 3G Systems," Hughes Systique Corporation, Jun. 28, 2006.
Microsoft Corporation, "IEEE 802.11 Networks and Windows XP," Windows Hardware Developer Central, Dec. 4, 2001.
Molisch, Andreas F., et al., "MIMO Systems with Antenna Selection—an Overview," Draft, Dec. 31, 2003.
Moose, Paul H., "Differential Modulation and Demodulation of Multi-Frequency Digital Communications Signals," 1990 IEEE,CH2831-6/90/0000-0273.
ORINOCO AP-2000 5GHz Kit, "Access Point Family," Proxim Wireless Corporation.
Pat Calhoun et al., "802.11r strengthens wireless voice," Technology Update, Network World, Aug. 22, 2005, http://www.networkworld.com/news/tech/2005/082208techupdate.html.
Press Release, Netgear RangeMax(TM) Wireless Networking Solutions Incorporate Smart MIMO Technology to Eliminate Wireless Dead Spots and Take Consumers Farther, Ruckus Wireles Inc. (Mar. 7, 2005), available at http://ruckuswireless.com/press/releases/20050307.php.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Sadek, Mirette, et al., "Active Antenna Selection in Multiuser MIMO Communications," IEEE Transactions on Signal Processing, vol. 55, No. 4, Apr. 2007, pp. 1498-1510.
Saltzberg, Burton R., "Performance of an Efficient Parallel Data Transmission System," IEEE Transactions on Communication Technology, vol. Com-15, No. 6, Dec. 1967, pp. 805-811.
Steger, Christopher et al., "Performance of IEEE 802.11b Wireless LAN in an Emulated Mobile Channel," 2003.
Toskala, Antti, "Enhancement of Broadcast and Introduction of Multicast Capabilities in RAN," Nokia Networks, Palm Springs, California, Mar. 13-16, 2001.
Tsunekawa, Kouichi, "Diversity Antennas for Portable Telephones," 39th IEEE Vehicular Technology Conference, pp. 50-56, vol. I, Gateway to New Concepts in Vehicular Technology, May 1-3, 1989, San Francisco, CA.
Varnes et al., A Switched Radial Divider for an L-Band Mobile Satellite Antenna, European Microwave Conference (Oct. 1995), pp. 1037-1041.
Vincent D. Park, et al., "A Performance Comparison of the Temporally-Ordered Routing Algorithm and Ideal Link-State Routing," IEEE, Jul. 1998, pp. 592-598.
W.E. Doherty, Jr. et al., The Pin Diode Circuit Designer's Handbook (1998).
Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.
Wennstrom, Mattias et al., "Transmit Antenna Diversity in Ricean Fading MIMO Channels with Co-Channel Interference," 2001.
Petition Decision Denying Request to Order Additional Claims for U.S. Pat. No. 7,193,562 (Control No. 95/001078) mailed on Jul. 10, 2009.
Right of Appeal Notice for U.S. Pat. No. 7,193,562 (Control No. 95/001078) dated Jul. 10, 2009.
European Examination Report for EP Application No. 05776697.4 dated Jan. 21, 2011.
European Second Examination Report for EP Application No. 07775498.4 dated Mar. 12, 2013.
European Third Examination Report for EP Application No. 07775498.4 dated Oct. 17, 2011.
European First Examination Report for EP Application No. 09014989.9 dated May 7, 2012.
Supplementary European Search Report for EP Application No. EP05776697.4 dated Jul. 10, 2009.
Supplementary European Search Report for EP Application No. EP07755519 dated Mar. 11, 2009.
PCT Application No. PCT/US2005/27023, International Search Report and Written Opinion dated Dec. 23, 2005.
PCT Application No. PCT/US2006/49211, International Search Report and Written Opinion dated Aug. 29, 2008.
PCT Application No. PCT/US2007/09276, International Search Report and Written Opinion dated Aug. 11, 2008.
Chinese Application No. 200680048001.7, Office Action dated Jun. 20, 2012.
Chinese Application No. 200780020943.9, Office Action dated Feb. 7, 2013.
Chinese Application No. 200780020943.9, Office Action dated Aug. 29, 2012.
Chinese Application No. 200780020943.9, Office Action dated Dec. 19, 2011.
Chinese Application No. 200910258884.X, Office Action dated Aug. 3, 2012.
Taiwan Application No. 094127953, Office Action dated Mar. 20, 2012.
Taiwan Application No. 096114265, Office Action dated Jun. 20, 2011.
U.S. Appl. No. 11/010,076, Office Action dated Oct. 31, 2006.
U.S. Appl. No. 11/010,076, Final Office Action dated Aug. 8, 2006.
U.S. Appl. No. 11/010,076, Office Action dated Dec. 23, 2006.
U.S. Appl. No. 11/022,080, Office Action dated Jul. 21, 2006.

(56) References Cited

OTHER PUBLICATIONS

U.S. Appl. No. 11/041,145, Final Office Action dated Jan. 29, 2007.
U.S. Appl. No. 11/041,145, Office Action dated Jul. 21, 2006.
U.S. Appl. No. 11/265,751, Office Action dated Mar. 18, 2008.
U.S. Appl. No. 11/413,461, Office Action dated Jun. 7, 2007.
U.S. Appl. No. 11/714,707, Final Office Action dated May 30, 2008.
U.S. Appl. No. 11/714,707, Office Action dated Oct. 15, 2007.
U.S. Appl. No. 11/924,082, Office Action dated Aug. 29, 2008.
U.S. Appl. No. 12/082,090, Office Action dated Jan. 18, 2011.
U.S. Appl. No. 12/404,124, Final Office Action dated Feb. 7, 2012.
U.S. Appl. No. 12/404,124, Office Action dated Sep. 19, 2011.
U.S. Appl. No. 12/953,324, Office Action dated Mar. 24, 2011.
U.S. Appl. No. 13/280,278, Office Action dated Mar. 25, 2013.
U.S. Appl. No. 13/280,278, Final Office Action dated Aug. 22, 2012.
U.S. Appl. No. 13/280,278, Office Action dated Feb. 21, 2012.
U.S. Appl. No. 13/305,609, Final Office Action dated Jul. 3, 2012.
U.S. Appl. No. 13/305,609, Office Action dated Dec. 20, 2011.
U.S. Appl. No. 13/485,012, Final Office Action dated Mar. 3, 2013.
U.S. Appl. No. 13/485,012, Office Action dated Oct. 25, 2012.
U.S. Appl. No. 12/980,253, Office Action dated Mar. 27, 2014.
U.S. Appl. No. 13/396,482, Final Office Action dated Mar. 28, 2014.
U.S. Appl. No. 13/439,844, Office Action dated Apr. 22, 2014.

* cited by examiner

RADIO FREQUENCY ANTENNA ARRAY WITH SPACING ELEMENT

BACKGROUND OF INVENTION

1. Field of the Invention

The present invention generally relates to wireless communications and more particularly to changing radio frequency (RF) emission patterns with respect to one or more antenna arrays.

2. Description of the Prior Art

In wireless communications systems, there is an ever-increasing demand for higher data throughput and a corresponding drive to reduce interference that can disrupt data communications. For example, a wireless link in an Institute of Electrical and Electronic Engineers (IEEE) 802.11 network may be susceptible to interference from other wireless access points and stations, radio transmitting devices in the vicinity of the network, and changes or disturbances in the wireless link environment between an access point and remote receiving node. In some instances, the interference may degrade the wireless link thereby forcing communication at a lower data rate. The interference may, in some instances, be sufficiently strong as to disrupt the wireless link altogether.

One solution is to utilize a diversity antenna scheme. In such a solution, a data source is coupled to two or more physically separated omnidirectional antennas. An access point may select one of the omnidirectional antennas by which to maintain a wireless link. Because of the separation between the omnidirectional antennas, each antenna experiences a different signal environment and corresponding interference level with respect to the wireless link. A switching network couples the data source to whichever of the omnidirectional antennas experiences the least interference in the wireless link.

Notwithstanding, many high-gain antenna environments still encounter—or cause—electromagnetic interference (EMI). This interference may be encountered (or created) with respect to another nearby wireless environments (e.g., between the floors of an office building or hot spots scattered amongst a single room). In some instances, the mere operation of a power supply or electronic equipment can create electromagnetic interference.

One solution to combat electromagnetic interference is to utilize shielding in or proximate an antenna enclosure. Shielding a metallic enclosure is imperfect, however, because the conductivity of all metals is finite. Because metallic shields have less than infinite conductivity, part of the field is transmitted across the boundary and supports a current in the metal. The amount of current flow at any depth in the shield and the rate of decay are governed by the conductivity of the metal, its permeability, and the frequency and amplitude of the field source.

With interference present in most environments, it is desirable to have a low-cost and effective solution to providing an antenna apparatus with reduced interference.

SUMMARY OF THE INVENTION

The presently claimed invention utilizes a spacing member positioned between antenna members. Two associated antenna members may be positioned next to each other to provide an increased gain. The spacing element may be placed between the antenna members and have a thickness related to the characteristic impedance of the antenna transmission line. The characteristic impedance may be determined based on the width of the transmission line. The spacing member may be radio-frequency (RF) transparent and may adhere to either or both of the antenna elements. The spacing member may include a plastic double sided tape, a uniform piece of plastic having one or more adhesive layers, or some other RF transparent material.

An embodiment of a wireless device may include an antenna array and a spacer element. The antenna array may include a plurality of antenna elements to generate a substantially omnidirectional radiation pattern. Each of the plurality of antenna elements may include a first antenna member and a second antenna member. The spacer element may be displaced between the first antenna member and the second antenna member.

DETAILED DESCRIPTION

Embodiments of the present invention implement a spacing member positioned between a pair of antenna members. The two antenna members may be horizontally polarized or vertically polarized and positioned next to each other to provide an increased gain. The spacing element may be placed between the antenna members and have a thickness corresponding to the characteristic impedance of the antenna transmission line. The characteristic impedance may be determined based on the width of the transmission line. The spacing member may be radio-frequency (RF) transparent and may adhere to either or both of the antenna elements. The spacing member may be implemented as a plastic double sided tape or a uniform piece of plastic having one or more adhesive layers. The antenna member pair having the spacing member may be used in a wireless antenna system.

Figure 1:
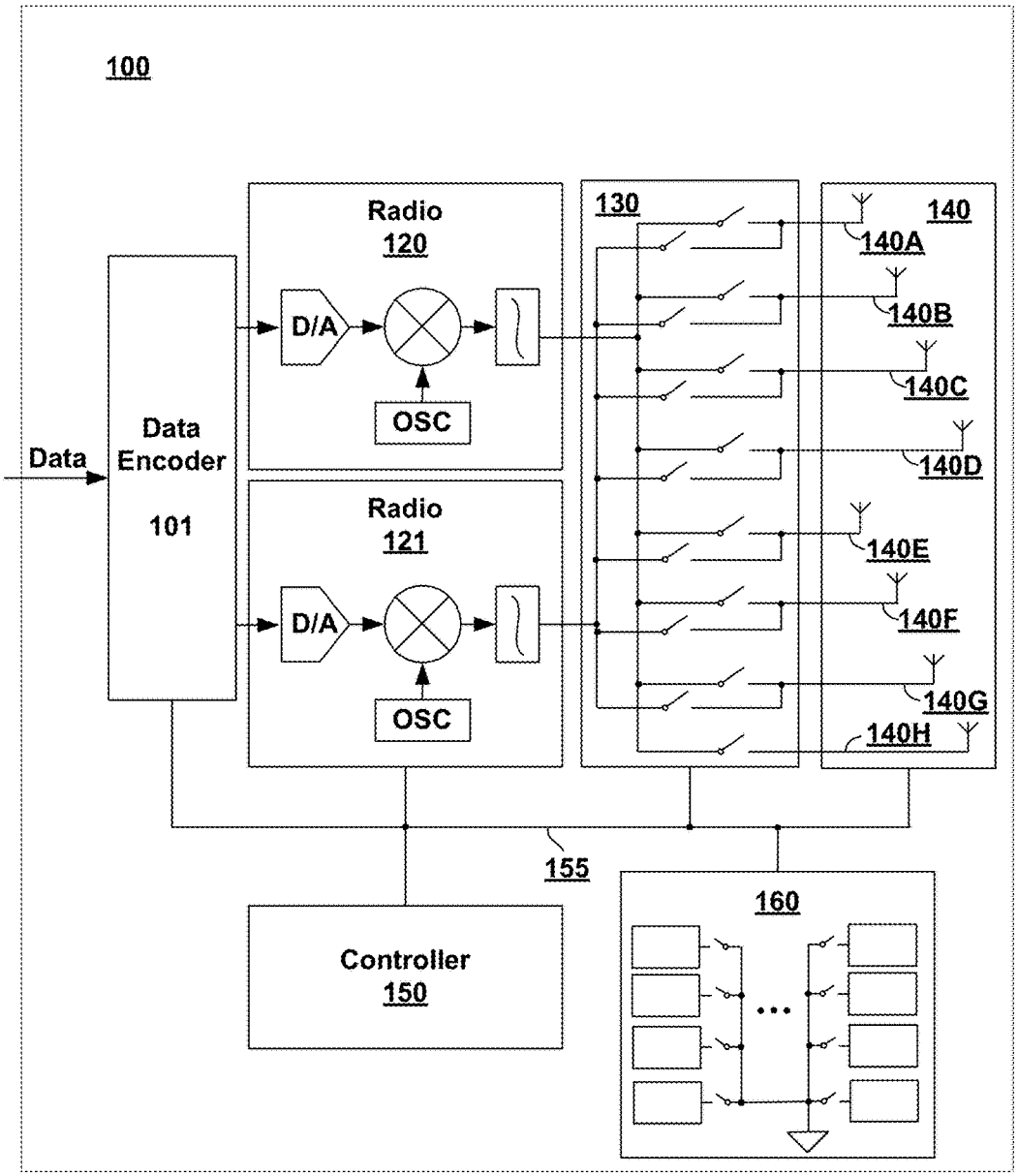
FIG. 1 illustrates a wireless MIMO antenna system having multiple antennas and multiple radios.

FIG. 1 illustrates a wireless MIMO antenna system having multiple antennas and multiple radios. The wireless MIMO antenna system 100 may be representative of a transmitter and/or a receiver such as an 802.11 access point or an 802.11 receiver. System 100 may also be representative of a set-top box, a laptop computer, television, Personal Computer Memory Card International Association (PCMCIA) card, Voice over Internet Protocol (VoIP) telephone, or handheld gaming device.

Wireless MIMO antenna system 100 may include a communication device for generating a radio frequency (RF) signal (e.g., in the case of transmitting node). Wireless MIMO antenna system 100 may also or alternatively receive data from a router connected to the Internet. Wireless MIMO antenna system 100 may then transmit that data to one or more of the remote receiving nodes. For example, the data may be video data transmitted to a set-top box for display on a television or video display.

The wireless MIMO antenna system 100 may form a part of a wireless local area network (e.g., a mesh network) by enabling communications among several transmission and/or receiving nodes. Although generally described as transmitting to a remote receiving node, the wireless MIMO antenna system 100 of FIG. 1 may also receive data subject to the presence of appropriate circuitry. Such circuitry may include but is not limited to a decoder, down conversion circuitry, samplers, digital-to-analog converters, filters, and so forth.

Wireless MIMO antenna system 100 includes a data encoder 101 for encoding data into a format appropriate for transmission to the remote receiving node via the parallel radios 120 and 121 illustrated in FIG. 1. While two radios are illustrated in FIG. 1, additional radios or RF chains may be utilized. Data encoder 101 may include data encoding elements such as direct sequence spread-spectrum (DSSS) or Orthogonal Frequency Division Multiplex (OFDM) encoding mechanisms to generate baseband data streams in an appropriate format. Data encoder 101 may include hardware and/or software elements for converting data received into the wireless MIMO antenna system 100 into data packets compliant with the IEEE 802.11 format. Such software elements may be embedded in memory or other non-transitory computer readable storage media and coupled to appropriate processing components. In some instances, the appropriate conversion elements may be implemented in the context of a hardware element such as an application specific processor.

Radios 120 and 121 as illustrated in FIG. 1 include transmitter or transceiver elements configured to upconvert the baseband data streams from the data encoder 101 to radio signals. Radios 120 and 121 thereby establish and maintain the wireless link. Radios 120 and 121 may include direct-to-RF upconverters or heterodyne upconverters for generating a first RF signal and a second RF signal, respectively. The first and second RF signals are generally at the same center frequency and bandwidth but may be offset in time or otherwise space-time coded.

Wireless MIMO antenna system 100 further includes a circuit (e.g., switching network) 130 for selectively coupling the first and second RF signals from the parallel radios 120 and 121 to an antenna apparatus 140 having multiple antenna elements 140A-H. Antenna elements 140A-H may include individually selectable antenna elements such that each antenna element 140A-H may be electrically selected (e.g., switched on or off). By selecting various combinations of the antenna elements 140A-H, the antenna apparatus 140 may form a "pattern agile" or reconfigurable radiation pattern. If certain or substantially all of the antenna elements 140A-H are switched on, for example, the antenna apparatus 140 may form an omnidirectional radiation pattern. Through the use of MIMO antenna architecture, the pattern may include both vertically and horizontally polarized energy, which may also be referred to as diagonally polarized radiation. Alternatively, the antenna apparatus 140 may form various directional radiation patterns, depending upon which of the antenna elements 140A-H are turned on.

The RF switches within circuit 130 may be PIN diodes, gallium arsenide field-effect transistors (GaAs FETs), or virtually any RF switching device. The PIN diodes comprise single-pole single-throw switches to switch each antenna element either on or off (i.e., couple or decouple each of the antenna elements to the radios 120 and 121). A series of control signals may be applied via a control bus 155 to bias each PIN diode. With the PIN diode forward biased and conducting a DC current, the PIN diode switch is on, and the corresponding antenna element is selected. With the diode reverse biased, the PIN diode switch is off. In some embodiments, one or more light emitting diodes (LEDs) may be included in the coupling network as a visual indicator of which of the antenna elements is on or off. An LED may be placed in circuit with the PIN diode so that the LED is lit when the corresponding antenna element is selected.

Further, the antenna apparatus may include switching at RF as opposed to switching at baseband. Switching at RF means that the communication device requires only one RF up/downconverter. Switching at RF also requires a significantly simplified interface between the communication device and the antenna apparatus. For example, the antenna apparatus provides an impedance match under all configurations of selected antenna elements, regardless of which antenna elements are selected.

Wireless MIMO antenna system 100 includes pattern shaping elements 160. Pattern shaping elements 160 in FIG. 1 extend from a printed circuit board. The pattern shaping elements may include directors and reflectors selectively connected to ground using, for example, a PIN diode. Directors may include passive elements that constrain the directional radiation pattern, for example, to increase the gain of the antenna member pair. Pattern shaping elements such as reflectors and directors are generally known in the art. The reflectors and directors may be metal objects having any shape and placed near an antenna array such as an antenna member pair mounted on a printed circuit board.

Wireless MIMO antenna system 100 may also include a controller 150 coupled to the data encoder 101, the radios 120 and 121, the circuit 130, and pattern shaping elements 160 via a control bus 155. The controller 150 may include hardware (e.g., a microprocessor and logic) and/or software elements to control the operation of the wireless MIMO antenna system 100.

The controller 150 may select a particular configuration of antenna elements 140A-H that minimizes interference over the wireless link to the remote receiving device. If the wireless link experiences interference, for example due to other radio transmitting devices, or changes or disturbances in the wireless link between the wireless MIMO antenna system 100 and the remote receiving device, the controller 150 may select a different configuration of selected antenna elements 140A-H via the circuit 130 to change the resulting radiation pattern and minimize the interference. Controller 150 may also select one or more pattern shaping elements 160. For example, the controller 150 may select a configuration of selected antenna elements 140A-H and pattern shaping elements 160 corresponding to a maximum gain between the wireless system 100 and the remote receiving device. Alternatively, the controller 150 may select a configuration of selected antenna elements 140A-H and pattern shaping elements 160 corresponding to less than maximal gain, but corresponding to reduced interference in the wireless link.

Controller 150 may also transmit a data packet using a first subgroup of antenna elements 140A-H coupled to the radio 120 and simultaneously send the data packet using a second group of antenna elements 140A-H coupled to the radio 121. Controller 150 may change the substrate of antenna elements 140A-H coupled to the radios 120 and 121 on a packet-by-packet basis. Methods performed by the controller 150 with respect to a single radio having access to multiple antenna elements are further described in, for example, U.S. patent publication number US 2006-0040707 A1. These methods are also applicable to the controller 150 having control over multiple antenna elements and multiple radios.

Figure 2:
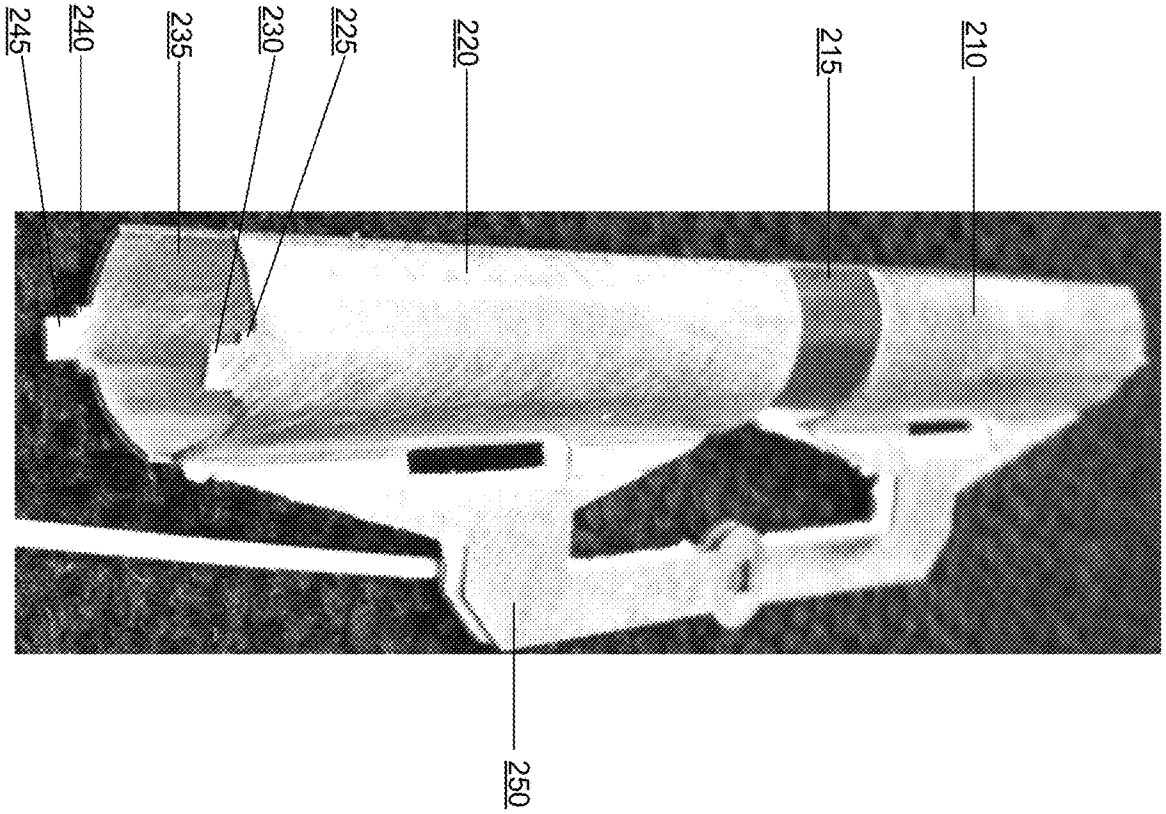
FIG. 2 illustrates a horizontally polarized antenna member pair for mounting on a printed circuit board.

FIG. 2 illustrates an antenna element (e.g., a dipole) for emitting a horizontally polarized radiation pattern for mounting on a printed circuit board. The antenna element illustrated in FIG. 2 includes a first antenna member and a second antenna member. The first antenna member includes an upper portion 210 and a lower portion 220. The second antenna member also includes an upper portion 215 and a lower portion 235. The antenna elements are connected at an RF feed point 250. When connected together, the first antenna member and second antenna member form an antenna member pair having a barrel-type shape with a slit near the middle of the structure. The antenna member pair of FIG. 2 may transmit a radiation pattern having a frequency of about 5.0 GHZ in compliance with IEEE 802.11n.

The horizontally polarized antenna member pair of FIG. 2 may be mounted to the surface of a PCB. Antenna member lower portions 220 and 235 include tabs 230 and 245, respectively. The tabs are constructed to fit into a printed circuit board and may be secured via solder. Above each tab on lower portions 220 and 235 are shoulders 225 and 240, respectively. The shoulder is designed to maintain a spacing of each antenna lower portion above the printed circuit board.

An RF signal may be fed to the horizontally polarized antenna member pair of FIG. 2 via connector 250. Connector 250 is formed by bending a tab from antenna member 210 into an aperture of antenna element 215, and soldering the connection between the elements.

Figure 3:
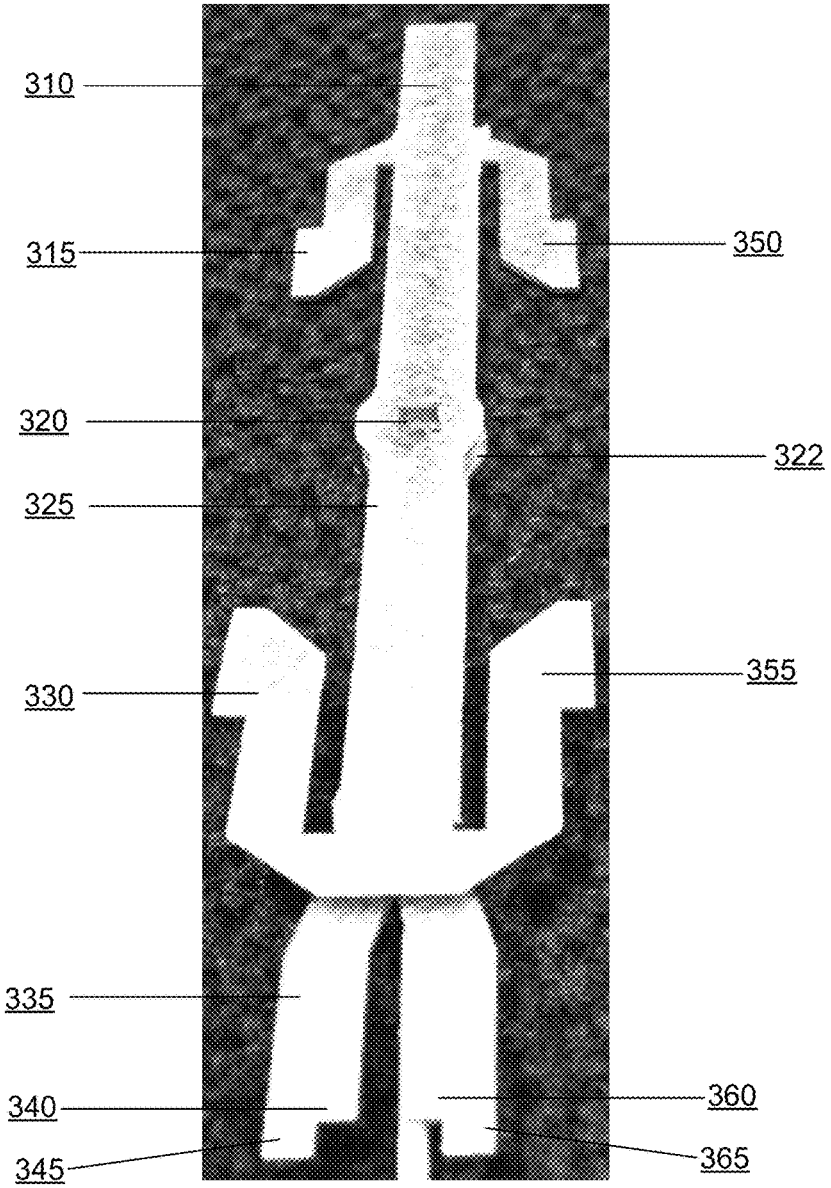
FIG. 3 illustrates a vertically polarized antenna member pair for mounting on a printed circuit board.

FIG. 3 illustrates a vertically polarized antenna member pair for mounting on a printed circuit board. The dipole of FIG. 3 includes a first antenna member 325 and a second antenna member 322. The first antenna member includes a first end 310 and a second end having two finger elements 330 and 355. The second antenna member has finger elements which are about the same as the first antenna member. The antenna members are connected together to align along their central axis such that the second antenna member is upside down with respect to the first antenna member. Hence, the fingers of the second antenna member are near the first end of the first antenna member, which is the opposite end of the fingers on the first antenna member. The antenna members are connected at an RF feed point 320. When connected together, the first antenna member and second antenna member form an antenna member pair which provides a horizontally polarized radiation pattern. The antenna member pair of FIG. 3 may transmit a radiation pattern having a frequency of about 5.0 GHZ in compliance with IEEE 802.11n.

As illustrated, second antenna member 322 includes finger elements 315 and 350. Finger elements 315 and 350 opposite to and form a magnetic pair with finger elements 330 and 355 of first antenna member 325.

The vertically polarized antenna member pair of FIG. 3 may be mounted to the surface of a PCB using tabs and shoulders. Antenna member 322 includes tabs 345 and 365 which may be received and soldered to a PCB. Above tabs 345 and 355 are shoulders 340 and 360, respectively. The shoulder is designed to engage the surface of the PCB.

An RF signal may be fed to the vertically polarized antenna member pair of FIG. 3 via RF feed point 320. RF feed point 320 is formed by bending a tab from antenna element 325 into an aperture of antenna element 322 and soldering the antenna members together.

Figure 4:
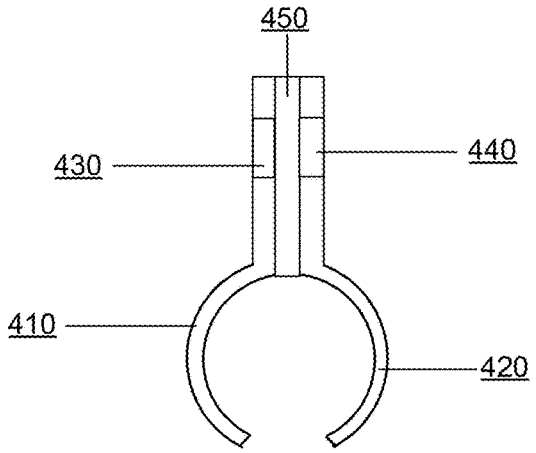
FIG. 4 illustrates a top view of a horizontally polarized antenna member pair.

FIG. 4 illustrates a top view of a horizontally polarized antenna member pair. The antenna member pair includes a first antenna member having a barrel portion 410 and connector portion 430 and a second member pair having a barrel portion 420 and connector portion 440. Connector portion 430 and connector portion 440 are each attached to spacing member 450. Spacing member 450 may extend along the entire depth of connector portions 430 and 440.

The spacing member may have a uniform thickness to maintain a constant distance between the first antenna member and second antenna member of the antenna member pair. In some embodiments, the spacing member may have a thickness of about 0.03 inches wide. The spacing member material may be transparent to a radio frequency signal so that no signal power is lost, reflected, or otherwise affected by the spacing member. The spacing member may be formed by an adhesive tape that is cut to fit between and match the general shape of the connector portions.

Figure 5:
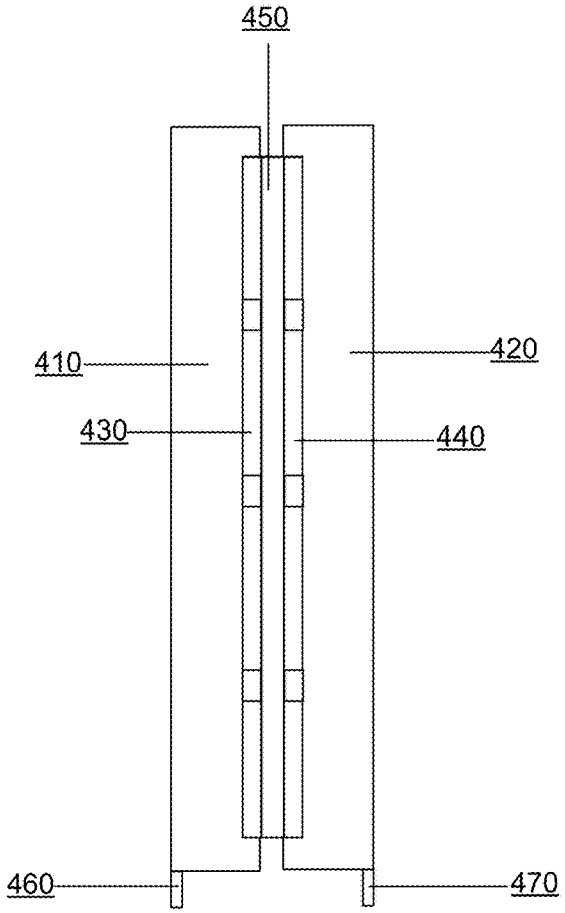
FIG. 5 illustrates a rear view of a horizontally polarized antenna member pair.

FIG. 5 illustrates a rear view of a horizontally polarized antenna member pair. The antenna member pair of FIG. 5 includes barrel portions 410 and 420 and connector portions 430 and 440, and tab portions 460 and 470. Spacing member 450 extends between connector portions 430 and 440. As illustrated, spacing member 450 may extend along the entire length of connector portions 430 and 440.

Figure 6:
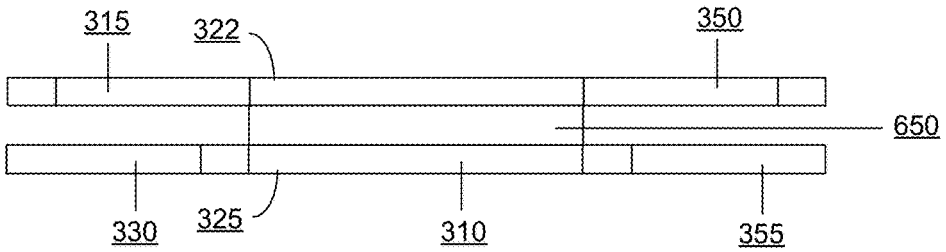
FIG. 6 illustrates a top view of a vertically polarized antenna member pair.

FIG. 6 illustrates a top view of a vertically polarized antenna member pair. The vertically polarized antenna member pair of FIG. 6 includes first antenna element 322 and second antenna element 325. First antenna element 322 includes finger elements 315 and 350. Second antenna element 325 includes finger elements 330 and 355 and top end 310. A spacing member 650 is located between the first antenna element 322 and second antenna element 325. Spacing member 650 extends along the entire width of top end 310 between the two antenna elements.

Figure 7:
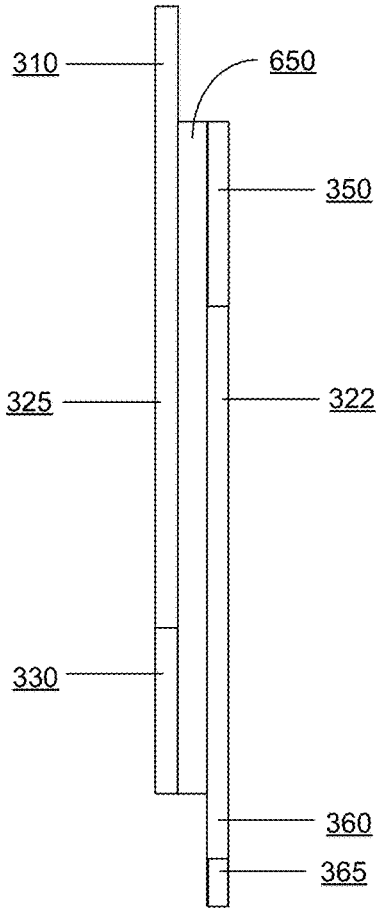
FIG. 7 illustrates a side view of a vertically polarized antenna member pair.

FIG. 7 illustrates a side view of a vertically polarized antenna member pair. Spacing member 650 extends along the length of first antenna element 325 and 322 which is common to both elements. For example, spacing member 650 extends vertically from the bottom of spacing member 330 to the top of spacing member 350.

Figure 8:
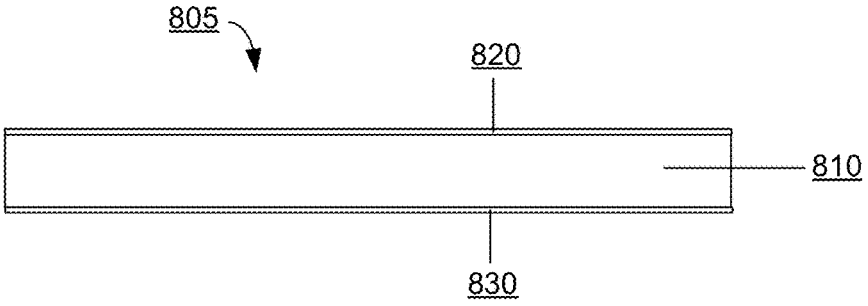
FIG. 8 illustrates a side view of a spacing member having an upper and lower adhesive layer.

A spacing member may be implemented differently in various embodiments of the invention. FIG. 8 illustrates a side view of a spacing member 805 having an upper and lower adhesive layer. Spacing member 805 may have a core 810, an upper adhesive layer 820, and a lower adhesive layer 830. The adhesive layers may be applied to spacing member core 810 before the member is positioned between a pair of antenna elements.

Figure 9:
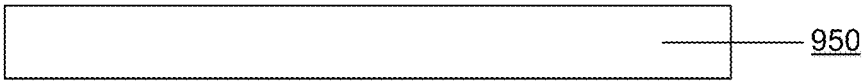
FIG. 9 illustrates a side view of an adhesive tape spacing member.

FIG. 9 illustrates a side view of adhesive tape spacing member 950. The adhesive tape spacing member 950 may inherently include an adhesive on an upper surface and lower surface. When used to adhere together a pair of antenna elements together, the adhesive tape spacing member 950 may be cut to match the surface of the antenna elements. In other aspects of the present invention, the antenna element pair dimensions may be designed around the thickness, desired length and other properties of the adhesive tape spacing member 950.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A wireless device, comprising:

an antenna array comprising a vertically polarized antenna element and a horizontally polarized antenna element that cooperate to generate a substantially omnidirectional radiation pattern, wherein each of the vertically polarized and horizontally polarized antenna elements comprises a first antenna member and a second antenna member, wherein the horizontally polarized antenna element and the vertically polarized antenna element are mounted on a printed circuit board (PCB) by respective tabs;

a first spacer element, different from the PCB, comprising an upper surface and a lower surface and displaced between the first antenna member and the second antenna member of the horizontally polarized antenna element; and a second spacer element, different from the PCB, comprising an upper surface and a lower surface and displaced between the first antenna member and the second antenna member of the vertically polarized antenna element, wherein the first antenna member and the second antenna member are connected at a radio frequency (RF) feed point, wherein an antenna transmission line is connected to the radio frequency (RF) feed point, and wherein the first spacer element has a thickness corresponding to a characteristic impedance of the antenna transmission line.

2. The wireless device of claim 1, wherein each of the first and second spacer elements is transparent to a radio frequency signal.

3. The wireless device of claim 1, wherein each of the first and second spacer elements is 0.03 inches wide.

4. The wireless device of claim 1, wherein each of the first and second spacer elements comprises an adhesive tape.

5. The wireless device of claim 1, wherein each of the first and second spacer elements further comprises an adhesive on both the upper surface and the a lower surface of the spacer element, the adhesive attaching each of the first and second spacer elements to an outer surface of the first antenna member and an outer surface of the second antenna member of each of the vertically and horizontally polarized antenna elements, respectively.

6. The wireless device of claim 1, further comprising two radios operating in parallel, wherein the two radios generate RF signals having a same center frequency and bandwidth; and a switching network that selectively couples the generated RF signals from the two radios to the antenna array.

7. The wireless device of claim 1, wherein the plurality of antenna elements are vertically positioned on a printed circuit board using one or more tabs and one or more shoulders, the one or more tabs being soldered to the printed circuit board and the one or more shoulders providing a spacing for the antenna elements above the printed circuit board based on the length of each shoulder.

8. The wireless device of claim 1, wherein the plurality of antenna elements are vertically positioned on a printed circuit board using one or more tabs.

* * * * *